United States Patent [19]

Frye

[11] Patent Number: 4,671,480

[45] Date of Patent: Jun. 9, 1987

[54] DEMOUNTABLE HOLDING DEVICE

[76] Inventor: Bruce J. Frye, P.O. Box 483, Milltown, Wis. 54858

[21] Appl. No.: 743,360

[22] Filed: Jun. 11, 1985

[51] Int. Cl.[4] ..... A47F 7/14

[52] U.S. Cl. ..... 248/205.3; 248/467

[58] Field of Search ..... 248/467, 489, 497, 498, 248/205.3, 205.4, 301, 304, 308, 339, 341; 24/304, DIG. 11, 230.5 R, 265 H

[56] References Cited

U.S. PATENT DOCUMENTS

| | | | |
|---|---|---|---|
| 2,122,999 | 7/1938 | Burke | 248/29 |
| 2,765,998 | 10/1956 | Engert | 248/29 |
| 2,809,001 | 10/1957 | Margulis | 248/467 |
| 3,012,748 | 12/1961 | Breslow | 248/205 |
| 3,052,436 | 9/1962 | Margulis | 24/DIG. 11 |
| 3,241,795 | 3/1966 | Frye | 248/205.3 |
| 3,856,249 | 12/1974 | Frye | 248/205 |
| 3,885,768 | 5/1975 | Frye | 248/467 |
| 4,003,538 | 1/1977 | Frye | 248/467 |
| 4,106,741 | 8/1978 | Hogg | 248/467 |

FOREIGN PATENT DOCUMENTS

| | | | |
|---|---|---|---|
| 228603 | 6/1958 | Australia | 248/467 |

*Primary Examiner*—J. Franklin Foss
*Assistant Examiner*—Robert A. Olson
*Attorney, Agent, or Firm*—Leo Gregory

[57] ABSTRACT

A demountable article holding device having a body portion adhesively coated for attachment to a supporting surface and having an intermediate portion thereof formed as a depending flap and having a rigid member therein having an article holding member secured thereto, the rigid member being particularly adapted to center upon the device the stress of the load held.

1 Claim, 4 Drawing Figures

DEMOUNTABLE HOLDING DEVICE

BACKGROUND OF THE INVENTION

1. Field of Invention

This invention relates to a flexible adhesively secured holding device.

2. Description of the Prior Art

The art of article holding devices or hangers is an active art and the applicant is the inventor of such prior art devices as exemplified in the following U.S. Pat. No. 3,856,249, a multilayered device as shown has layers secured at weld points spaced from the perimeter thereof. In U.S. Pat. No. 3,885,768 a naturally self holding separable holding device has a centrally disposed hook member. In U.S. Pat. No. 4,003,538 a layered device is disclosed rupturable for removal and having a hook article bearing member.

It is desirable to have an article holding device of simple structure which provides an improvement in load bearing capacity.

SUMMARY OF THE INVENTION

It is an object of this invention to provide a holding device or hanger of a single layered construction arranged to have the holding member thereof disposed in such a manner as to result in significant improvement in load bearing capacity.

More particularly it is an object of the invention herein to provide a holding device comprising a single layer of material having an intermediate portion thereof wrapped about a rigid member of corresponding width, said rigid member depending as a free flap and having secured thereto a load bearing member whereby the major stress of the load is centered upon said rigid member and upon the device.

It is a further object of this invention to provide a single layered holding device having a body portion having an adhesive coated surface to engage a supporting surface and having an intermediate portion thereof disposed about a rigid elongated member, said member forming a depending free flap and being spaced from the remainder of said body portion by a web, said flap carrying an article holding member such as a hook, the load upon said hook being centered upon said rigid member and being minimized at the ends of said flap whereby the major stress of the load is centrally of the device reducing significantly the incidence of peel back at the side edges thereof and enhancing greatly the load bearing capacity of the device.

It has been found that polystyrene is a very suitable plastic sheet material from which to form said device as the sheet material is very stable and has no migrating ingredients.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
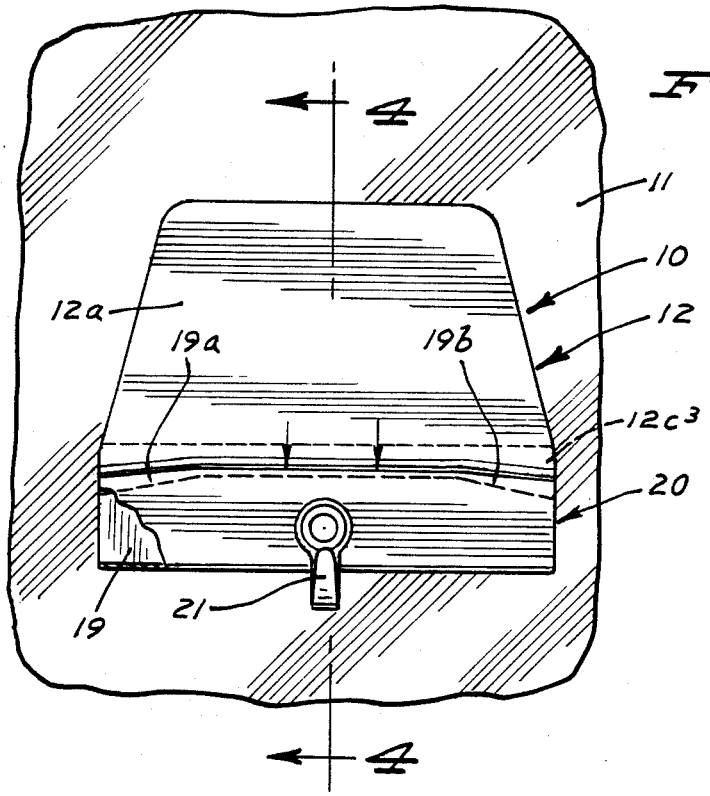
FIG. 1 is a top plan view of the holding device herein in an operating position.

Referring to the drawings, the demountable holding device or hanger herein is indicated generally by the reference numeral 10. The body 12 of said hanger has been found to be very suitably formed of a plastic sheet material known commercially as polystyrene. A thickness of 0.001 inches has proved to be very suitable. This material contains no ingredients therein which migrate such as occurs with plasticizers in some plastics. Said hanger is illustrated mounted onto a supporting surface or wall 11.

The underside 14 of said body portion 12 is shown here having a coating of a layer of a suitable tacky non-drying pressure sensitive adhesive 16. Said underside 14 may be otherwise prepared to have an adhering surface.

A protective cover sheet 17 overlies the tacky surface or underside 14 as a protective coating, the same being removed when the device is put to use.

In the present embodiment, the body portion 12 is single layered and substantially rectangular in form having a tapered upper portion 12*a*.

Figure 2:
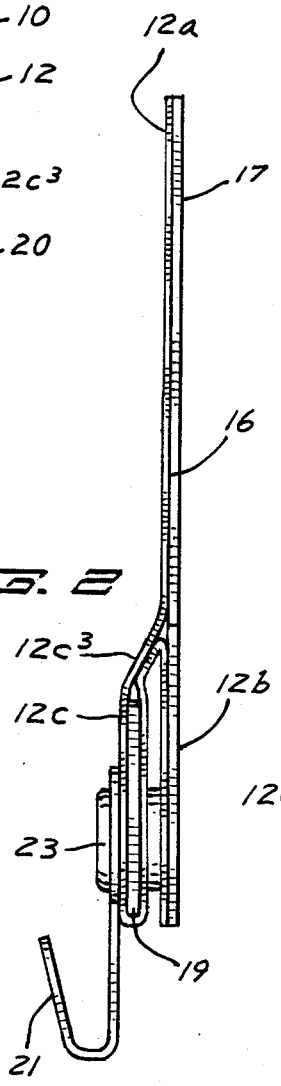
FIG. 2 is a view of the device herein in side elevation.
Figure 3:
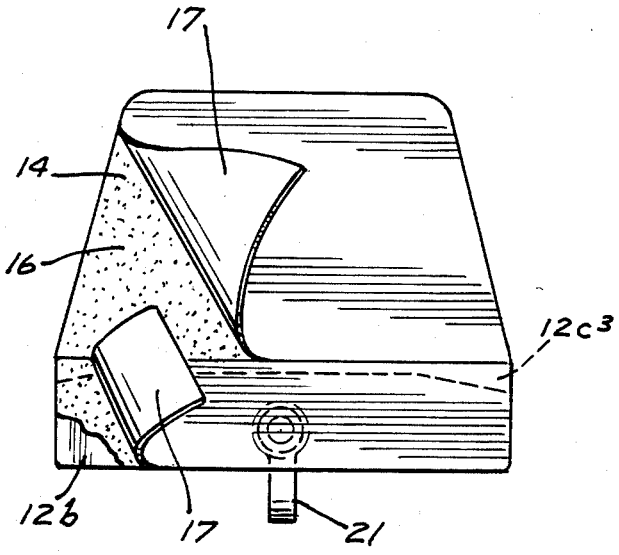
FIG. 3 is a rear plan view showing portions to be removable.
Figure 4:
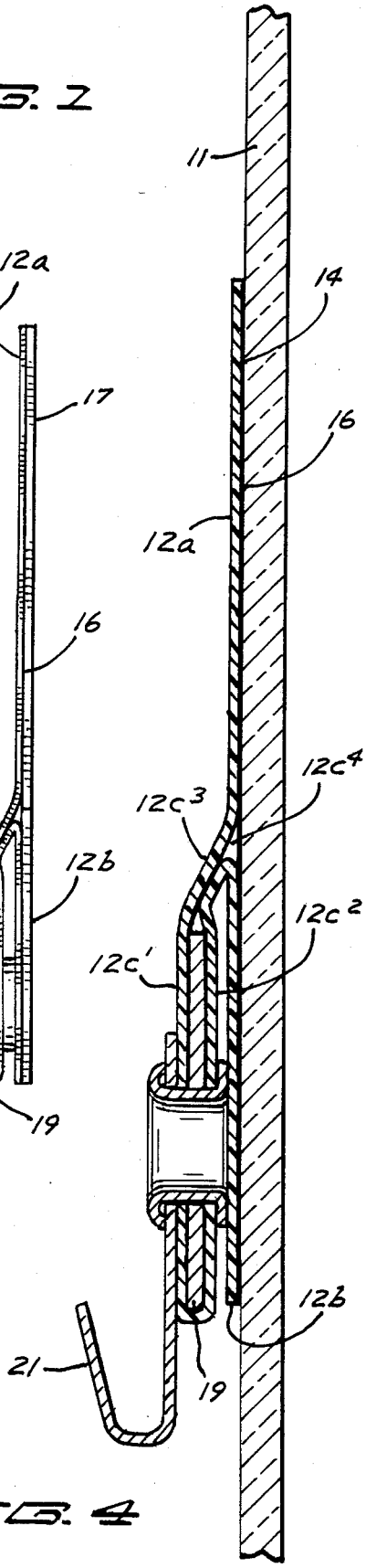
FIG. 4 is a view in vertical section taken on line 4—4 of FIG. 1 as indicated.

As can be seen from FIGS. 2 and 4, the body 12 is formed to have said upper portion 12*a*, a lower rectangular portion 12*b* and an intermediate portion 12*c*.

Said intermediate portion 12*c* is wrapped about a co-extensive rigid insert 19 which is preferably formed of a metal. Said member 19 is shown having tapered upper edge portions as at 19*a* and 19*b*.

Thus said intermediate portion 12*c* forms a free hanging apron or flap 20. Applied to said flap centrally transversely thereof is a hook member 21 which as here shown is secured by an eyelet 23 through said rigid member.

The intermediate portion or flap 12*c* in looking at FIG. 4, has a front side $12c^1$, a rear side $12c^2$ and their juncture at $12c^3$, which juncture is formed as a web spacing the flap from the body portions 12*a* and 12*b*. It is noted that said web merges into said body portions 12*a* and 12*b* at the line indicated as $12c^4$ and at this point good contact is made with the supporting surface in positioning the device. It is desirable to have a solid engagement along this line with the supporting surface.

The device is placed into operating position by peeling off the cover coat 17 and pressing the body portions 12*a* and 12*b* against a supporting surface making good solid contact and particularly along the line $12c^4$. The particular configuration of the rigid member 19 centers the pull of the load upon the device and minimizes the stress upon the outer side edge portions of the device.

OPERATION

The use of the hanger 10 herein is believed to be clear from the description given.

In hanging an article onto the hook member 21, the particular construction of the hanger centers the load of the article held to be upon the central portion of the rigid member 19 within said flap 20. The tapered upper edge portions 19*a* and 19*b* of said rigid member and their degree of taper controls the degree of the stress of the load that is centered upon the said body portions 12*a* and 12*b* avoiding the tendency for peel back particularly at the side edges of the flap $12c^3$.

It has been found that the construction as described generally enhances the load bearing capacity of the device and much of this is due to the flap construction 20 and the use of the rigid member 19 therein and the degree of taper of the edge portions 19*a* and 19*b*, all separated from the main body portions 12*a* and 12*b* by the web 12*c*$^3$. The avoidance of peel back adds very substantially to the load bearing capacity of the device.

It will of course be understood that various changes may be made in the steps and sequence of steps of the method without departing from the scope of applicant's invention which, generally stated, consists in a method capable of carrying out the objects above set forth, such as disclosed and defined in the appended claims.

What is claimed is:

1. A demountable article hanger, having in combination a unitary body member, an adhering surface on one side of said body member, a rigid elongated member across the width of said body member, an intermediate portion of said body member being disposed about said rigid member forming therewith a free hanging flap, said flap being spaced from the remainder of said body portion, said rigid member having tapered upper edge portions, whereby the stress of an applied load centers upon said flap and through said flap centers upon the remainder of said body member avoiding peel back at the side edge portions of said body member.

* * * * *